United States Patent [19]

Rouse et al.

[11] 3,999,495

[45] Dec. 28, 1976

[54] CAN END TRANSFER MECHANISM

[75] Inventors: John W. Rouse, Fairlawn; Elmer C. Bouquot, Fairfield, N.J.

[73] Assignee: American Can Company, Greenwich, Conn.

[22] Filed: Apr. 2, 1976

[21] Appl. No.: 673,151

[52] U.S. Cl. ..... 113/113 R; 72/405; 72/421

[51] Int. Cl.[2] ..... B21D 43/10; B21D 51/44

[58] Field of Search ..... 113/1 F, 113 R, 113 C, 113/114 BA, 114 BE; 72/405, 420, 421, 422, 428; 214/1 BB

[56] References Cited

UNITED STATES PATENTS

| | | | |
|---|---|---|---|
| 1,966,529 | 7/1934 | Stevens | 113/114 BE |
| 2,297,730 | 10/1942 | Turnock et al. | 198/225 |
| 2,383,313 | 8/1945 | Hoffman et al. | 113/113 C |
| 2,484,095 | 10/1949 | Johnson | 113/113 R |
| 3,380,282 | 4/1968 | Scaletta et al. | 113/113 R |
| 3,528,575 | 9/1970 | McCaughey | 198/218 |
| 3,557,425 | 1/1971 | Scharf | 113/1 F |

*Primary Examiner*—Michael J. Keenan
*Attorney, Agent, or Firm*—Robert P. Auber; Thomas M. Galgano; Ira S. Dorman

[57] ABSTRACT

A can end transfer mechanism for use in a highspeed machine includes a generally horizontal base with an end-receiving pocket and a pair of can end-engaging members disposed on opposite sides of the pocket. Each of the members has an inner end portion which projects into the pocket and is dimensioned and configured to engage an opposite side of an end, so as to cooperatively constrain it against rotation in the pocket. The engaging members are resiliently mounted on the base for movement along axes which are inclined toward the vertical axis of the pocket; this facilitates insertion and removal of an end into and from the pocket, while effectively maintaining the relative lateral position of an end when received therein. The mechanism is particularly useful where proper registry of work sequentially performed on the end tends to be of critical importance.

14 Claims, 7 Drawing Figures

FIG. 3
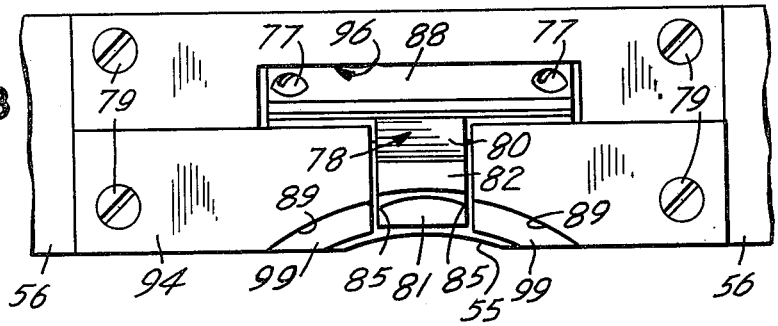
FIG. 4
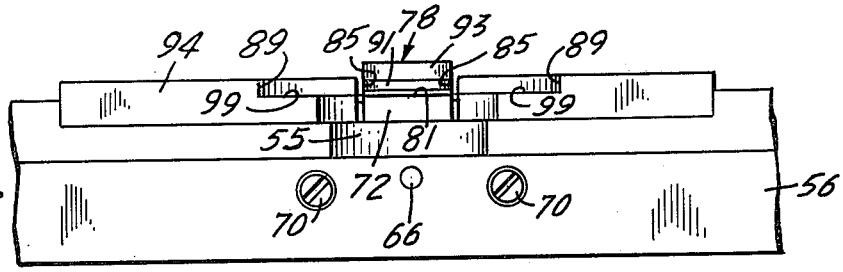
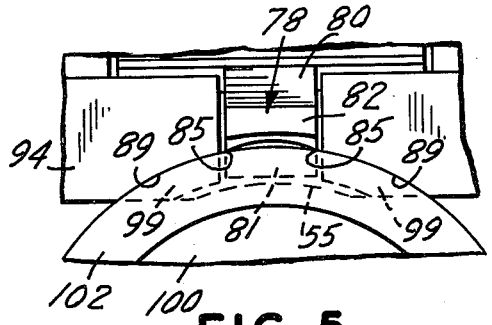
FIG. 5
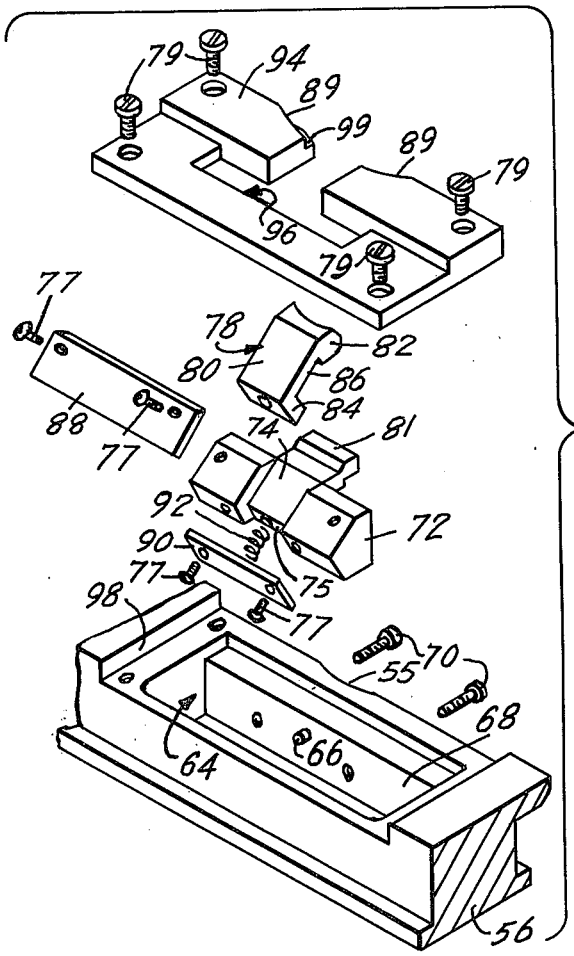
FIG. 7
FIG. 6
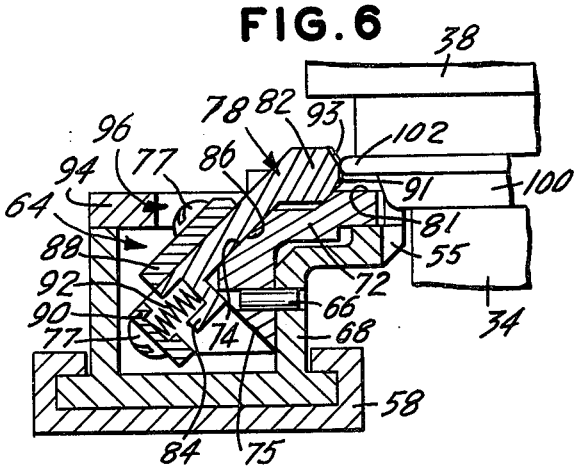

CAN END TRANSFER MECHANISM

BACKGROUND OF THE INVENTION

Various types of mechanisms have in the past been employed to transfer can ends from one work station to another of a press, whereat various forming operations, such as scoring, rivet formation, etc., are sequentially performed on the ends. In the course of this progressive end-forming procedure, it is often imperative that the can end be transferred from one station to the next without a change in its angular orientation or lateral position. Otherwise, incorrect registry of the work performed on the end will result, ultimately leading to a defective can end.

While satisfactory at moderate speeds, most presently-known can end transfer devices are found to be less satisfactory when operated at high speeds, particularly from the standpoint of affording adequately precise position control. This is due in part to the tendency of machine movement to be transmitted to the can end, with a consequential tendency for the position of the end in the transfer device to be changed. Moreover, in high-speed press operations, it is necessary that the mechanism be especially efficient in accepting and releasing ends quickly and facilely, and without damage to them.

Accordingly, it is an object of this invention to provide a novel can end transfer mechanism for a machine, which mechanism is efficient, suited to high-speed operation, and capable of affording precise position control of ends transferred thereby.

It is also an object of this invention to provide such a transfer mechanism by and from which can ends may be quickly and facilely accepted and released, without damage to the ends.

A further object of this invention is to provide such a novel transfer mechanism which is simple, economical, durable and convenient to use.

SUMMARY OF THE INVENTION

It has now been found that certain of the foregoing and related objects of the invention are readily attained in a transfer mechanism for moving a can end between first and second, laterally spaced work stations of a high-speed machine, including a generally horizontal base having formed in its upper surface at least one downwardly extending end-receiving pocket. A pair of can end-engaging members are disposed on opposite sides of the pocket, and each member has an inner end portion which projects into the pocket and is dimensioned and configured to engage an opposite side of an end, so that the pair of members cooperatively constrain the end against rotation in the pocket. The mechanism additionally includes means for resiliently mounting the engaging members on the base for movement along axes which are inclined toward the vertical axis of the pocket; preferably, the inclined axes are at an angle of about forty-five degrees to the vertical axis of the pocket. As a result of the angular disposition and resilient mounting of the engaging members, ends may be facilely inserted into and removed from the pocket, and while their relative lateral positions therein may be effectively maintained.

Preferably, the pocket is of circular cross section to adapt it for the receipt of a circular can end, with the inner end portions of each of the engaging members having a concave inner surface configuration. Most advantageously, the inner surface of each of the inner end portions is formed with a uniform radius which is shorter than the radius of the pocket (the latter corresponding to that of the can end for which it is designed), and is bevelled at its upper edge to facilitate entry of an end therebetween. In addition, it is highly desirable that the inner surface of the inner end portion of each engaging member terminate in a pair of circumferentially spaced, relatively sharp rectilinear edges, which are disposed parallel to the vertical axis of the pocket; such a construction will effectively prevent rotation of the can end in the pocket, without inhibiting its facile entry and exit thereinto and therefrom. In particularly preferred embodiments, the base includes a pair of spaced-apart, parallel rail members, which have opposed recesses formed in the confronting surfaces thereof, to cooperatively define the end-receiving pocket of the base. The rail members may also have a narrow ledge portion extending into the pocket, to provide underlying support for a can end seated thereon.

Most advantageously, the resilient mounting means includes a support member for each of the engaging members which has an angled surface thereon, on which the engaging member is slidably seated. Preferably, the support member has a right angle channel formed therein, and has a first section thereof which slopes inwardly and upwardly toward the axis of the pocket, and a second section which slopes inwardly and downwardly theretoward, with the first section providing the angled surface of the support member. In such a construction, the engaging member is provided with a rectilinear intermediate portion, which is slidably engaged on the first section of the channel and which is slightly greater in length, and also with a foot portion at the outer end thereof projecting inwardly and downwardly at a right angle to the intermediate portion, toward the pocket axis. The foot portion serves as a stop to limit movement of the engaging member along the first channel section, by contact with the second section thereof. Finally, the resilient mounting means includes a spring, which biases the engaging member toward the pocket axis.

BRIEF DESCRIPTION OF THE DRAWINGS

FIG. 3 is a fragmentary plan view, drawn to a further enlarged scale, of a portion of one rail of the transfer bar of the mechanism of the foregoing Figures, the illustrated portion having an end-engaging mechanism mounted therein;

FIG. 4 is a front elevational view of the rail portion shown in FIG. 3;

FIG. 5 is a fragmentary plan view of a section of the rail portion shown in FIGS. 3 and 4, showing a can end fully inserted into the pocket thereof;

FIG. 6 is a fragmentary, cross-sectional view through the center of the pocket of one rail of the transfer bar of the mechanism of the foregoing Figures, drawn to a scale further enlarged from that of FIGS. 3 through 5, and showing a can end in its position of initial contact with the inner end of the engagement finger, during insertion into the end-receiving pocket; and FIG. 7 is an exploded perspective view of an end-engaging mechanism and associated portion of the transfer bar shown in the previous Figures, drawn to a scale approximating that of FIG. 2.

DETAILED DESCRIPTION OF THE ILLUSTRATED EMBODIMENT

Figure 1:
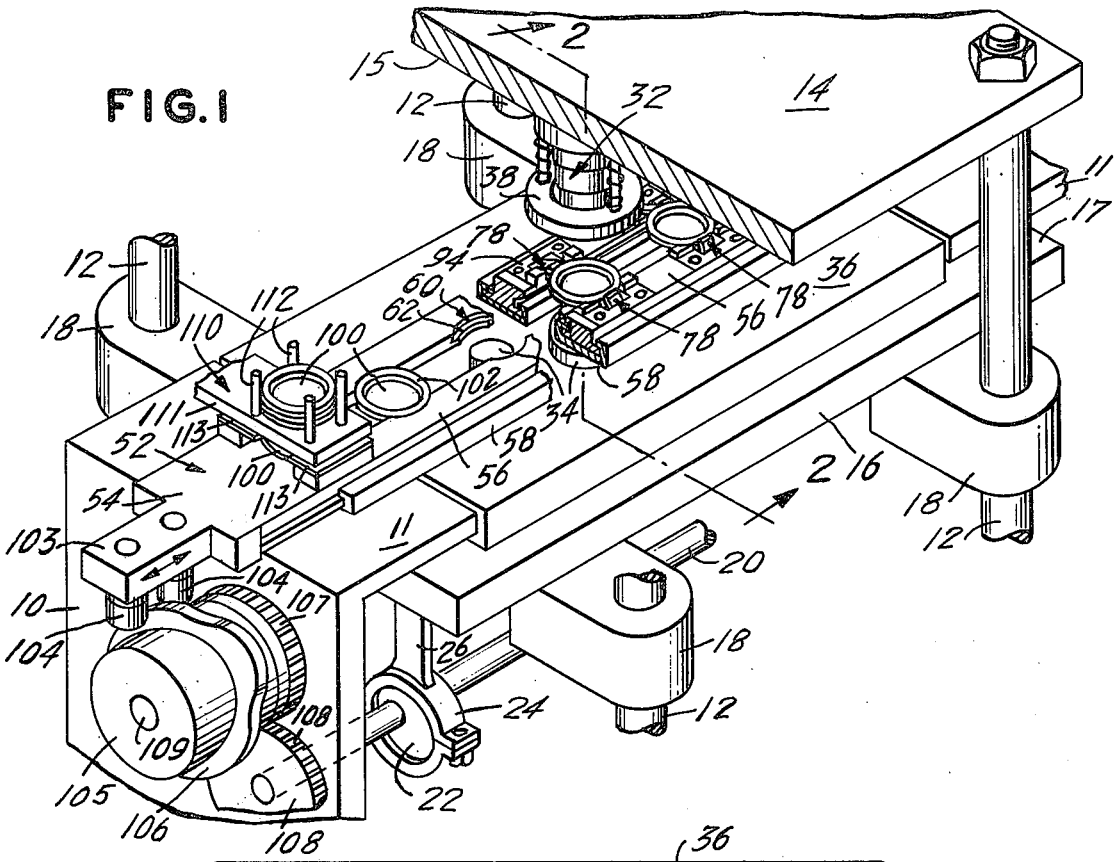
FIG. 1 is a fragmentary perspective view of a high-speed inverted conversion press utilizing a can end transfer mechanism embodying the present invention.

Turning now in detail to the appended drawings, therein illustrated is a can end transfer mechanism embodying the present invention, employed in a high-speed inverted conversion press. The press includes a frame 10 (only portions of which are shown), having four upright cylindrical posts 12 to which a horizontal bolster plate 14 is rigidly secured. A vertically reciprocable, horizontal platen 16 is disposed beneath the bolster plate 14, and has corner sleeve portions 18 in which the posts 12 are slidably received.

A crankshaft 20, driven by suitable means (not shown), is rotatably mounted in the frame 10 beneath the platen 16, and has an eccentric 22 secured to it. The eccentric 22 is disposed within the guide collar portion 24 of a pitman 26, the upper end of which (not shown) is, in turn, pivotally connected (by means not shown) to the underside of the platen 16. As will be apparent, rotational movement of the shaft 20 is translated by the eccentric 22 and the pitman 26 into vertical reciprocation of the platen 16.

Four linearly aligned end-forming die sets (only one complete set being illustrated, for purposes of clarity), consisting of an upper member, generally designated by the numeral 32, and a lower member 34, are secured by means of die shoes 36 to the lower face 15 of plate 14 and the upper face 17 of the platen 16, respectively. Each set defines a work station at which a forming operation is performed on edge-curled, circular metal blanks 100, fed thereto. In operation, the end blanks 100, supported on the lower die members 34, are lifted by the lower platen 16; forming is effected by coaction of the lower members 34 with the mating upper members 32 on the stationary bolster plate 14, which occurs at the top of the stroke of the platen 16.

Figure 2:
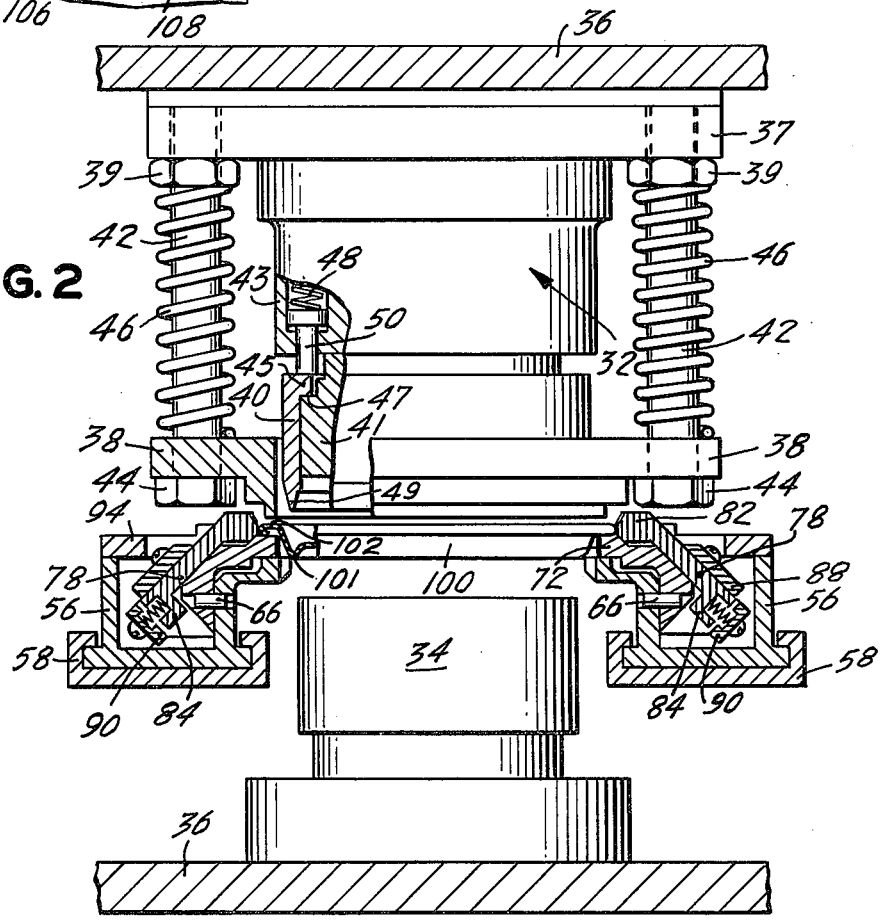
FIG. 2 is a fragmentary, elevational view of the press of FIG. 1, taken along line 2—2 thereof and drawn to a scale enlarged therefrom.

As can be seen best in FIG. 2, the upper die members 32 include a spring-loaded knock-out ring 38, and a similarly loaded, cylindrical knock-out collar 40, both of which are concentrically mounted about the forming die element 41. The outer ring 38 is slidably mounted on a pair of bolts 42, which are threadably engaged in the base portion 37 of the upper die member 32, and is fixed in proper position by a pair of nuts 39. The ring 38 is downwardly biased against the heads 44 of the bolts 42 by coil springs 46 mounted thereon. Similarly, the inner collar 40 is downwardly biased by coil springs 48, which act thereon through spring plungers 50 (only one of the coil springs and plungers being shown), which are disposed within an upper housing portion 43 of the die member 32; as can be seen, downward travel of the collar 40 is limited by interference of its inner circumferential lip 45 with the element 41, which has a circumferential shoulder 47 formed therein to seat the lip 45. As can also be seen, the lower edge 49 of the collar 40 is tapered for close-fitting engagement in the circular groove 101 which is formed in each blank 100, thus best adapting the collar 40 to serve a centering, as well as a stripping, function.

The blanks 100 are successively advanced from one station to the next by a transfer bar, generally designated by the numeral 52, comprised of a platform portion 54 at one end and a pair of spaced rail members 56 extending therefrom. As will be noted, the underside of the platform portion 54 and the lower parts of the rail members 56 are configured for slidable engagement of the transfer bar 52 in upwardly-opening, U-shaped tracks 58, which are, in turn, supported on the inwardly-extending shelf portions 11 of the frame 10.

A number of end-receiving pockets are defined in the rail members 56, by the provision of pairs of cooperating arcuate recesses 60, which are formed in confronting, opposed relationship therein. Within each recess 60, a ledge 62 is provided, which is dimensioned and configured to seat thereon, and to provide underlying support for, one of the end blanks 100. The pockets are spaced and aligned to correspond with the spacing and alignment of the die sets comprising the end forming stations, so that, in lifting the end blanks 100 on the upstroke of the platen 16, the lower die members 34 pass upwardly through the pockets. The spacing between the rail members 56 is sufficient to permit the die members 34 to pass therethrough, thereby enabling reciprocation of the transfer bar 52 with the platen 16 in elevated positions, to achieve maximum operating speeds.

Turning now particularly to FIGS. 3–7 of the drawings, therein provided is the most detailed illustration of the construction of the end-engaging mechanisms associated with the fourth and fifth pockets of the transfer bar 52 (as seen in FIGS. 1 and 2). Since all of the end-engaging mechanisms are of the same construction, a detailed description of only one of them is deemed sufficient.

To accommodate the engaging mechanisms, each of the rail members 56 of the transfer bar 52 has formed in it, at an appropriate location adjacent the corresponding pocket, a cavity 64. A short alignment pin 66 projects inwardly into the cavity 64 from the inner wall 68 of the member 56 (which wall 68 is parallel to the axis of the pocket) and, in cooperation with a pair of fasteners 70, mounts a support block 72 thereon. The block 72 has formed along its rear surface a shallow, right angle channel consisting of upper and lower sections 74, 75, respectively; the channel is centrally disposed in the block 72, and each section 74, 75 thereof forms an angle of about 45° with the front face 76 of the block 72, the latter being secured directly against the wall 68; thus, the channel sections are disposed at an angle of about 45° to the pocket axis.

Slidably seated within the channel 74 of the block 72 is an engagement finger, generally designated by the numeral 78. The finger 78 consists of a generally rectangular body 80 having a head portion 82 at one end and a foot portion 84 at the opposite end thereof. A substantially rectangular recess 86 is formed in the underside of the finger 78, and mates closely with the channel section 74 of the block 72; however, the recess 86 is slightly longer than the section 74, so as to permit a small degree of movement of the finger 78 therein.

The finger 78 is confined within the right angle channel of the block 72 by an upper plate 88 and a backing plate 90, which are affixed to the block by suitable fasteners 77. A short coil spring 92, mounted between appropriate recesses provided respectively in the plate 90 and the finger 78, serves to bias the finger 78 upwardly and inwardly toward the pocket of the rail member 56. Finally, a cover plate 94, having an appropriately configured opening 96 formed therein, is secured by suitable fasteners 79 within the shallow recess 98 formed in the upper surface of the rail member 56 for that purpose. As will be evident, where the engaging mechanisms are employed, the end-receiving pockets are cooperatively defined by portions of the rail members 56, cover plates 94, and engaging mechanisms. Thus, as seen in FIGS. 2–6, the upper, inner edge of the rail member 56 is provided with a concave surface 55, which defines the lower vertical wall on one side of the pocket. The upper inner edge of the cover plate 94 is recessed to provide concave vertical wall sections 89 and horizontal annular surfaces 99, the former defining the uppermost vertical wall of the pocket, and the latter, together with the top surface 81 of the finger support member 72, defining the horizontal seating ledge of the pocket.

The head portion 82 of each of the fingers 78 projects into its associated pocket, and has a concave inner surface, the upper portions 93 of which are bevelled to facilitate insertion of the can ends 100, by permitting them to cam the fingers 78 apart and by serving a centering function. In addition, the inner surface 91 is formed with a radius of curvature which is less than the radius of the pocket, so that four point contact (seen best in FIG. 5) may occur between the circumferentially-spaced, relatively sharp, rectilinear edges 85 of the fingers 78 and a can end 100 received therebetween. As will be appreciated, concentration of the holding force applied by the fingers 78 at four points maximizes their effectiveness in restraining rotation of the end 100 in the pocket; however, this is achieved without sacrifice of facility of insertion and removal, because of the alignment of the edges 85 with the vertical axis of the corresponding pocket. It should also be noted that the resiliency of the fingers 78, constrained to axes which are at an angle to the vertical axis of the pocket (due to the disposition of the channel section 74 of the block 72), enhances maintenance of the lateral position of an end blank 100 held thereby. While the angle may be varied, 45° has been found to provide an optimum balance between stability and positional accuracy of a supported end, and facile insertion and removal thereof into and from the pocket.

As seen in FIG. 1, the transfer bar 52 has a cam follower support block 103 projecting outwardly from the platform portion 54, on which block is carried a pair of depending cam followers 104. A cam wheel 105, having an upstanding undulating rib 106, is secured to shaft 109, with the rib 106 disposed between the cam followers 104, causing them to ride on the opposite sides thereof. The shaft 109 is journaled in the frame 10, and carries a gear 107 which is in meshing engagement with the gear 108 mounted on the crankshaft. Accordingly, rotation of the crankshaft 20 turns the cam wheel 105, which movement is translated by the rib 106 and cam followers 104 into reciprocation of the transfer bar 52. Since the transfer bar 52 and the platen 16 are driven from a common prime mover, their operation will be synchronized.

The end blanks 100 may be supplied to the transfer bar 52 from a stacking frame, shown fragmentarily in FIG. 1 and being generally designated therein by the numeral 110. The frame 110 is comprised of a base 111, which has a circular opening formed therein (obscured by the stack of end blanks 100), about which four upstanding posts 112 are positioned for lateral constraint of the vertical stack of blanks 100. The frame 110 is supported above the transfer bar 52 (by means not shown) so that, upon reciprocation of the transfer bar 52 therebelow, its vertical axis (and consequently that of the stack of ends 100) alternately aligns over the platform portion 54 of the bar 52 and the adjacent first pocket thereof (which, in FIG. 1, is aligned beneath the stacking axis). Although not fully illustrated, rigidly secured to the upper surface of the rail members 56, along the opposite sides of the first pocket, is a pair of blades 113, which project inwardly into the recesses 60. The blades 113 are disposed to pass between the lowermost blank 100 in the stack and the one directly above it, engaging opposite sides of their curled, circumferential flanges 102. When the transfer bar 52 reaches its fully retracted position, the bottom blank 100 drops into the first pocket (then aligned under the stacking frame 100), with the blanks 100 thereabove being supported upon the blades 113. Upon extension of the bar 56, the blank 100 is advanced to the first station (an idle station) while the remaining blanks 100 drop onto the platform portion 54, and into position for entry of the blades 113 for feeding of the next blank 100. At this time, the lower platen 16 is on its upward stroke, and member 34 lifts the blank an amount sufficient to clear the first pocket and to bring it into clamping engagement with the upper member 32, whereat it is held while the transfer bar 52 returns to its retracted position to pick up the next blank. Thereafter, the platen 16 moves downwardly to lower the blank into the second pocket, for sequential transfer to the first forming station. The blanks are successively advanced, in similar fashion, to each of the other end forming stations.

Following completion of the forming operation at the second forming station, the platen 16 moves downwardly to lower the blank 100 into the fourth pocket of the transfer bar 52, which includes the first pair of end engaging fingers 78. Initially, as seen more clearly in FIG. 6, after coaction of die members 32, 34, the pair of knock-out members 38, 40 cooperate to strip the end blank 100 from the upper die 32, as the lower die 34 is retracted, and impart sufficient inertia (particularly ring 38) to the blank 100 to effect its insertion between the pair of fingers 78 associated with the underlying pocket.

Thus, as shown in FIG. 6, as the blank 100 is injected into the pocket, it initially contacts the bevelled edges 93 of the fingers 78, causing the fingers 78 to retract downwardly and outwardly from the axis of their associated pocket. Guided by the lead-in of the bevelled edges 93, the blank 100 moves downwardly along the vertical, parallel, rectilinear edges 85 of the fingers 78 (FIG. 5), which ultimately clamp the blank 100 therebetween in four-point contact; the blank 100 is, of course, also supported from below by the ledge-defining surfaces 81, 99. So restrained in the pocket, the blank 100 is advanced by the transfer bar 52 to the next work station, in proper registry for the forming operation to be effected thereat. Release of the can end is effected simply by applying upward force, such as with an appropriate die member.

While the instant transfer mechanism has been described in relation to the illustrated and preferred embodiment, it should be understood that modifications may be made, as will be apparent to those skilled in the art. For example, while it is preferred that the mechanism employ a rectilinearly-reciprocable transfer bar, instead, it may be adapted for rotary movement. Additionally, it should be noted that the can ends may be fed to the transfer bar by other equivalent means. It should also be pointed out that, although the instant transfer mechanism is especially valuable in preventing rotation of circular can ends, a suitably configured mechanism may be employed for the transfer of non-circular can ends. Finally, it should be appreciated that, as shown in the drawings, the engaging mechanisms would not normally be employed at each pocket of the transfer bar, but are only required where maintenance of precise position of the can end during its transfer between two sequential operations tends to be critical.

Thus, it can be seen that the present invention provides a novel can end transfer mechanism for a machine, which is efficient, suited for use at high speeds, and capable of affording precise position control of ends transferred thereby. Can ends may be rapidly facilely accepted and released by and from the mechanism, without damage to the ends, and the mechanism is simple, economical, durable and convenient to use.

What is claimed is:

1. A transfer mechanism for moving a can end between first and second, laterally spaced work stations of a high-speed machine, the combination comprising: a generally horizontal base having formed in its upper surface at least one downwardly extending, can end-receiving pocket; a pair of can end-engaging members disposed on opposite sides of said pocket, each of said members having an inner end portion which projects into said pocket, and is dimensioned and configured to engage an opposite side of an end, so as to enable said members to cooperatively constrain the end against rotation in said pocket; and means for resiliently mounting said engaging members on said base for movement along axes which are inclined toward the axis of said pocket, the angular disposition and resilient mounting of said engaging members permitting facile insertion and removal of an end into and from said pocket, while effectively maintaining the relative lateral position of an end received therein.

2. The mechanism of claim 1 wherein each of said inclined axes is at an angle of about 45° to said axis of said pocket.

3. The mechanism of claim 1 wherein said pocket is of circular cross section to adapt it for the receipt of a circular can end, and wherein said inner end portion of each of said engaging members has a concave inner surface configuration.

4. The mechanism of claim 3 wherein said inner surface of each of said inner end portions is formed with a uniform radius which is shorter than the radius of said pocket.

5. The mechanism of claim 4 wherein said inner surface of each of said end portions terminates in a pair of circumferentially spaced, rectilinear edges, said edges being relatively sharp and being parallel to said axis of said pocket.

6. The mechanism of claim 3 wherein the upper surfaces of said inner end portions of said engaging members are bevelled to facilitate entry of a can end therebetween.

7. The mechanism of claim 1 wherein said base includes a pair of spaced-apart, parallel rail members, said rail members having opposed recesses formed in the confronting surfaces thereof to cooperatively define said end-receiving pocket of said base, each of said rail members having a narrow ledge portion extending into said pocket, to provide underlying support for a can end received therein.

8. The mechanism of claim 7 wherein each of said inclined axes is at an angle of about 45° to said axis of said pocket.

9. The mechanism of claim 8 wherein said pocket is of circular cross section to adapt it for the receipt of a circular end, and wherein said inner end portion of each of said engaging members has a concave inner surface configuration.

10. The mechanism of claim 9 wherein said inner surface of each of said inner end portions is formed with a uniform radius which is shorter than the radius of said pocket.

11. The mechanism of claim 10 wherein said inner surface of said end portions terminates in a pair of circumferentially spaced rectilinear edges, said edges being relatively sharp and being parallel to said pocket axis.

12. The mechanism of claim 11 wherein the upper edges of said inner end portions of said engaging members are bevelled to facilitate entry of a can end therebetween.

13. The mechanism of claim 1 wherein said resilient mounting means includes a support member for each of said engaging members thereof, said support member having an angled surface thereon, on which said engaging member is slidably seated.

14. The mechanism of claim 13 wherein said support member has a right angle channel formed therein, said angled surface being provided by a first section thereof which slopes inwardly and upwardly toward said axis of said pocket, with a second section of said channel sloping inwardly and downwardly toward said pocket axis; wherein said engaging member has a rectilinear intermediate portion slidably engaged on said first section of said channel and being slightly greater in length, and a foot portion at the outer end thereof projecting inwardly and downwardly at a right angle to said intermediate portion, toward said pocket axis, said foot portion serving as a stop to limit movement of said engaging member along said first channel section by contact with said second section thereof; and wherein said resilient mounting means additionally includes a spring biasing said engaging member toward said pocket axis.

* * * * *